US010174467B1

(12) United States Patent
Li et al.

(10) Patent No.: US 10,174,467 B1
(45) Date of Patent: Jan. 8, 2019

(54) SELF-RESETTING FRICTION-DAMPING SHOCK ABSORPTION BEARING AND SHOCK ABSORPTION BRIDGE

(71) Applicant: Sichuan University, Chengdu, Sichuan (CN)

(72) Inventors: Wenqiang Li, Sichuan (CN); Huaibang Han, Sichuan (CN); Yan Li, Sichuan (CN); Song Li, Sichuan (CN); Yudong Zhao, Sichuan (CN); Fei Li, Sichuan (CN)

(73) Assignee: Sichuan University, Chengdu (CN)

( * ) Notice: Subject to any disclaimer, the term of this patent is extended or adjusted under 35 U.S.C. 154(b) by 0 days.

(21) Appl. No.: 16/016,561

(22) Filed: Jun. 23, 2018

(30) Foreign Application Priority Data

Aug. 17, 2017 (CN) ..... 2017 1 0710863

(51) Int. Cl.
*E01D 19/04* (2006.01)

(52) U.S. Cl.
CPC ..... *E01D 19/042* (2013.01)

(58) Field of Classification Search
CPC ..... E01D 19/042; E02D 31/08
USPC ..... 14/73.5; 52/167.4
See application file for complete search history.

(56) References Cited

U.S. PATENT DOCUMENTS 3,921,240 A * 11/1975 Fyfe ..... E01D 19/047 14/73.5
5,509,238 A * 4/1996 Scalfati ..... E04H 9/021 52/167.4
5,597,240 A * 1/1997 Fyfe ..... E01D 19/041 14/73.5
8,011,142 B2 * 9/2011 Marioni ..... E04H 9/023 248/560
9,051,733 B2 * 6/2015 Yamao ..... F16F 7/08

FOREIGN PATENT DOCUMENTS

| | | | |
|---|---|---|---|
| CN | 204825622 | U | 12/2015 |
| CN | 106087719 | A | 11/2016 |
| CN | 205741889 | U | 11/2016 |
| CN | 106638281 | A | 5/2017 |
| CN | 206143622 | U | 5/2017 |
| JP | 2003240051 | A | 8/2003 |

* cited by examiner

*Primary Examiner* — Gary S Hartmann
(74) *Attorney, Agent, or Firm* — Wayne & Ken, LLC; Tony Hom

(57) ABSTRACT

A self-resetting friction-damping shock absorption bearing and a shock absorption bridge. The shock absorption bearing includes a first bearing plate, a second bearing plate, a support panel, a friction member, a first shock absorption member, and a second shock absorption member. The first bearing plate is connected to the support panel, both ends of the friction member are respectively connected to the second bearing plate and one end of the support panel away from the first bearing plate, and the friction member can slide relative to the support panel and the second bearing plate. A shock absorption bridge including a self-resetting friction-damping shock absorption bearing is also provided.

8 Claims, 7 Drawing Sheets

SELF-RESETTING FRICTION-DAMPING SHOCK ABSORPTION BEARING AND SHOCK ABSORPTION BRIDGE

TECHNICAL FIELD

The present invention relates to the field of shock absorption technology, and in particular, to a self-resetting friction-damping shock absorption bearing and a shock absorption bridge.

BACKGROUND

With the development of modern high-speed railways, the proportion of bridges in railway lines is increasing. When a seismic disaster occurs, the bridge is the most vulnerable part; the use of bridge shock absorption and isolation bearing installations is a practical and feasible shock absorption method, and it is also a kind of anti-seismic technology with mature development and extensive application. At present, the main domestic anti-seismic bearing installations include anti-seismic pot rubber fixing bearings, lead core rubber bearings, friction pendulum seismic isolation bearings, etc.

The anti-seismic pot rubber fixing bearing has a good damping property, and it isolates upper and lower seismic motions through shear deformation, and has the advantages of simple structure, simple manufacturing process, easy installation, and low cost. However, there are also some limitations, specifically, such as low horizontal stiffness and yield strength, low hysteretic performance, lack of vertical and horizontal self-resetting capability, rubber tending to age, no effective constraint on the horizontal displacement between upper and lower plates, an excessive displacement easily leading to the danger of falling bridges.

The lead core rubber bearing has a high energy dissipation capacity, and the internal stress caused by various creep deformations is small, but the shear performance of the bearing is greatly affected by the vertical load. With the increase in lead cores, the recovery ability of the bearing will be weakened, and the bearing cannot play an effective role in seismic reduction and isolation in multi-dimensional random earthquakes.

The friction pendulum seismic reduction and isolation bearing relies on the friction pendulum motion of two curves to achieve seismic reduction and isolation, and reduces the effect of seismic force by prolonging the natural vibration period and friction energy dissipation of the structure. The elevation of the spherical surface changes during swinging, and by raising the upper structure, the potential energy can work and be dissipated; after the earthquake, the bearing can be reset by the weight of the upper structure. However, it will cause a change and increase in the height of the bridge body, which, on the one hand, will affect the smoothness of tracks of railway bridges and affect traffic safety, and on the other hand, will produce additional internal stress, and then affect the overall mechanical structure of bridges, especially not applicable to railway simple bridges or long-span continuous bridges. Moreover, the bearing also has a large spherical radius, a large structure dimension, and high costs.

SUMMARY

An object of the present invention is to provide a self-resetting friction-damping shock absorption bearing, which has a simple structure and can effectively improve horizontal energy dissipation and resetting ability without affecting the overall mechanical structure of the bridge.

Another object of the present invention is to provide a shock absorption bridge, which has a simple structure and can effectively improve horizontal energy dissipation and resetting ability without affecting the overall mechanical structure of the bridge.

The present invention provides a technical solution:

a self-resetting friction-damping shock absorption bearing, including a first bearing plate, a second bearing plate, a support panel, a friction member, a first shock absorption member, and a second shock absorption member. The first bearing plate is connected to the support panel, both ends of the friction member are respectively connected to the second bearing plate and one end of the support panel away from the first bearing plate, and the friction member can slide relative to the support panel and the second bearing plate. One end of the first shock absorption member is connected to the friction member, and the other end of the first shock absorption member is connected to the support panel. One end of the second shock absorption member is connected to the friction member, and the other end of the first shock absorption member is connected to the second bearing plate.

Further, the friction member is provided with a first slide rail and a second slide rail, the first slide rail and the second slide rail being respectively provided on two opposite sides of the friction member, the support panel being connected to the first slide rail and being slidable relative to the first slide rail, the second bearing plate being connected to the second slide rail and being slidable relative to the second slide rail.

Further, the extending direction of the first slide rail and the extending direction of the second slide rail are perpendicular to each other.

Further, a first wear-resistant layer is bonded between the first slide rail and the support panel, a second wear-resistant layer is also bonded between the second slide rail and the second bearing plate, and the first wear-resistant layer and the second wear-resistant layer are planar or folded.

Further, the first shock absorption member is provided in the extending direction of the first slide rail, and the second shock absorption member is provided in the extending direction of the second slide rail.

Further, the first shock absorption member includes a first connecting portion, a second connecting portion, and a shock absorption connecting portion, both ends of the shock absorption connecting portion being respectively connected to the first connecting portion and the second connecting portion, the first connecting portion being connected to the support panel, the second connecting portion being connected to the side of the friction member away from the support panel.

Further, the cross-sectional dimension of the shock absorption connecting portion is greater than the cross-sectional dimension of the first connecting portion, or larger than the cross-sectional dimension of the second connecting portion.

Further, the first connecting portion is snapped, welded or screwed to the support panel.

Further, a first shock absorption portion is provided on the side of the support panel near the first bearing plate, and a second shock absorption portion that fits the first shock absorption portion is provided on the side of the first bearing plate near the support panel.

A shock absorption bridge includes a bridge body, a pier column, and a self-resetting friction-damping shock absorption bearing. The self-resetting friction-damping shock absorption bearing includes a first bearing plate, a second bearing plate, a support panel, a friction member, a first shock absorption member, and a second shock absorption member. The first bearing plate is connected to the support panel, both ends of the friction member are respectively connected to the second bearing plate and one end of the support panel away from the first bearing plate, and the friction member can slide relative to the bearing plate and the second bearing plate. One end of the first shock absorption member is connected to the friction member, and the other end of the first shock absorption member is connected to the support panel. One end of the second shock absorption member is connected to the friction member, and the other end of the first shock absorption member is connected to the second bearing plate. The self-resetting friction-damping shock absorption bearing is located between the bridge body and the pier column, and the first bearing plate is connected to the bridge body, and the second bearing plate is connected to the pier column.

Compared with the prior art, the self-resetting friction-damping shock absorption bearing and the shock absorption bridge provided by the present invention have the following beneficial effects:

when the seismic intensity is small, the support panel, the second bearing plate and the friction member remain fixed, that is, the support panel and the second bearing plate cannot slide relative to the friction member, thereby ensuring horizontal stiffness and transferring horizontal force, to ensure the normal operation of trains; when the seismic intensity is high, the constraint between the friction member and the second bearing plate and the support panel is released, and the frictional resistance between the friction member and the second bearing plate and the support panel caused by sliding displacement dissipates seismic energy; the occurrence of the displacement of the self-resetting friction-damping shock absorption bearing can prolong the basic natural vibration period of the bridge structure, achieving cushioning and shock absorption; the displacement decomposition in two directions can be adapted to the horizontal displacement of an earthquake in any direction, reducing damages to the structure. Horizontal displacement and energy dissipation do not cause the height of the bearing to change, and do not affect the mechanical structure of the bridge. At the same time, the movement of the friction member causes deformation of the first shock absorption member and the second shock absorption member, and absorbs a large amount of energy during the hysteretic process of deformation and recovery. The resetting of the first shock absorption member and the second shock absorption member can drive the movement between the relatively sliding support panel and the friction member and the movement between the second bearing plate and the friction member toward the center balance position of the second bearing plate and the support panel to achieve automatic resetting. The first shock absorption member and the second shock absorption member control the relative displacement between the friction member, the support panel and the second bearing plate within a certain range, so as to prevent a bridge falling accident caused by an excessive displacement. The self-resetting friction-damping shock absorption bearing and the shock absorption bridge provided by the present invention have simple structures, and can effectively improve the horizontal energy dissipation and resetting ability without affecting the overall mechanical structure of the bridge.

BRIEF DESCRIPTION OF THE DRAWINGS

In order to more clearly explain the technical solutions of the embodiments of the present invention, the drawings used in the embodiments will be briefly described below. It should be understood that the following drawings merely illustrate certain embodiments of the present invention and therefore should not be taken as limiting the scope. For those of ordinary skill in the art, other related drawings may also be obtained according to these drawings without any creative work.

Figure 1:
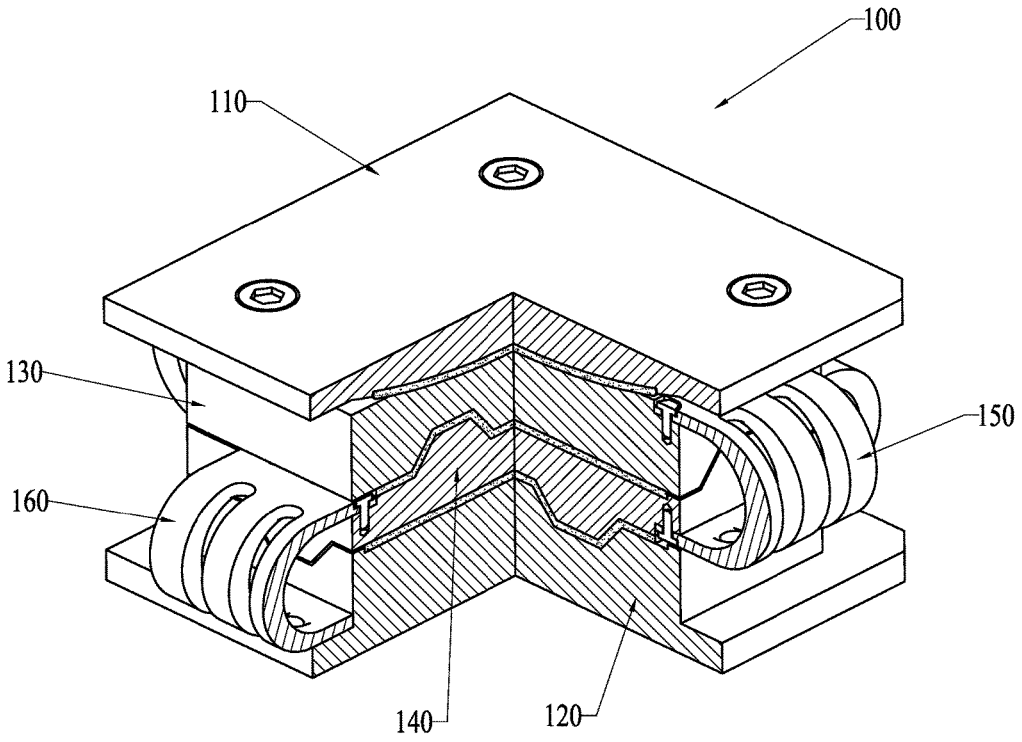
FIG. 1 is a schematic sectional structural diagram of a self-resetting friction-damping shock absorption bearing provided by a first embodiment of the present invention.

Reference signs: 100—self-resetting friction-damping shock absorption bearing; 110—first bearing plate; 111—second shock absorption portion; 112—third wear-resistant layer; 120—second bearing plate; 130—support panel; 131—first shock absorption portion; 140—friction member; 141—first slide rail; 142—second slide rail; 150—first shock absorption member; 151—first connecting portion; 152—second connecting portion; 153—shock absorption connecting portion; 160—second shock absorption member; 170—pin; 181—first wear-resistant layer; 182—second wear-resistant layer; 191—shock absorption rubber; 192—bolt.

DETAILED DESCRIPTION OF THE EMBODIMENTS

To make the objectives, technical solutions, and advantages of the embodiments of the present invention clearer, the technical solutions in the embodiments of the present invention will be clearly and completely described below with reference to the accompanying drawings in the embodiments of the present invention. Obviously, the described embodiments are a part of the embodiments of the present invention, rather than all the embodiments. The components of the embodiments of the invention, which are generally described and illustrated in the drawings herein, may be arranged and designed with a wide variety of different configurations.

Thus, the following detailed description of the embodiments of the invention provided in the drawings is not intended to limit the scope of the invention as claimed, but is merely representative of selected embodiments of the invention. All other embodiments obtained by a person of ordinary skill in the art based on the embodiments of the present invention without creative efforts shall fall within the protection scope of the present invention.

It should be noted that like reference numerals and letters refer to similar items in the following figures, and therefore, once an item is defined in one figure, it need not be further defined and explained in subsequent figures.

In the description of the present invention, it is to be understood that the terms "upper", "lower", "inner", "outer", "left", "right", and the like indicate the orientation or positional relationship based on the drawings, or an orientation or positional relationship that is conventionally placed in use of the inventive product, or an orientation or positional relationship that is conventionally understood by those skilled in the art, is merely for convenience of description of the present invention and simplification of description, rather than indicating or implying that the device or element referred to must have a particular orientation, be constructed and operated in a particular orientation, and therefore should not be construed to limit the invention.

Moreover, the terms "first," "second," etc. are used merely to distinguish one description from another, and are not to be construed as indicating or implying relative importance.

In the description of the present invention, it should also be noted that, unless explicitly stated or defined otherwise, terms such as "provide", "connect", etc. should be understood broadly. For example, "connect" may indicate a fixed connection or a disassemble connection, or an integral connection, may indicate a mechanical connection or an electrical connection, and may indicate a direct connection, or an indirect connection through intermediate media, or an internal connection between two components. Those of ordinary skill in the art can understand the specific meanings of the above terms in the present invention according to specific circumstances.

The specific embodiments of the present invention will be described in detail below with reference to the accompanying drawings.

First Embodiment

Figure 2:
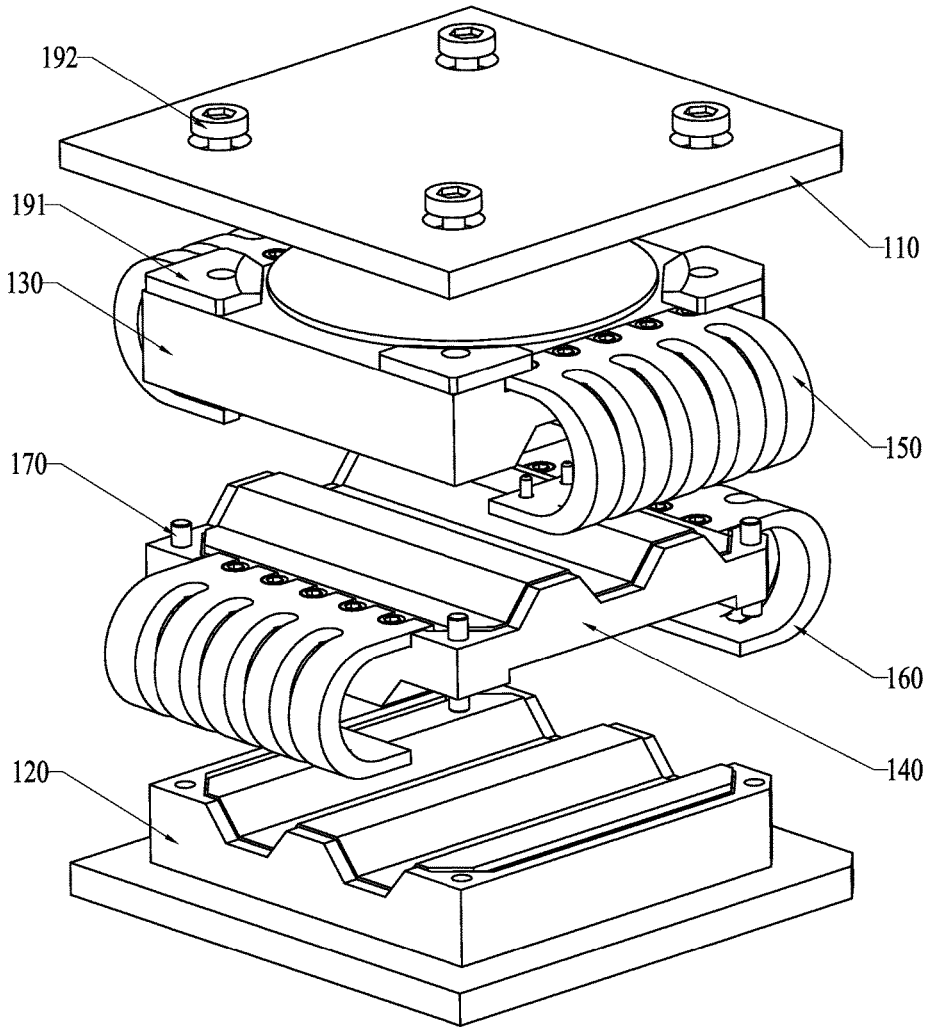
FIG. 2 is a schematic diagram of an exploded structure of the self-resetting friction-damping shock absorption bearing provided by the first embodiment of the present invention.

Referring to FIG. 1 and FIG. 2, this embodiment provides a self-resetting friction-damping shock absorption bearing 100, which has a simple structure and can effectively improve horizontal energy dissipation and resetting ability without affecting the overall mechanical structure of a bridge.

The self-resetting friction-damping shock absorption bearing 100 provided in this embodiment includes a first bearing plate 110, a second bearing plate 120, a support panel 130, a friction member 140, a first shock absorption member 150, and a second shock absorption member 160. The first bearing plate 110 is connected to the support panel 130, both ends of the friction member 140 are respectively connected to the second bearing plate 120 and one end of the support panel 130 away from the first bearing plate 110, and the friction member 140 can slide relative to the support panel 130 and the second bearing plate 120. One end of the first shock absorption member 150 is connected to the friction member 140, and the other end of the first shock absorption member 150 is connected to the support panel 130. One end of the second shock absorption member 160 is connected to the friction member 140, and the other end of the first shock absorption member 150 is connected to the second bearing plate 120.

It should be noted that, when the seismic intensity is small, the support panel 130 and the second bearing plate 120 and the friction member 140 remain fixed, that is, neither the support panel 130 nor the second bearing plate 120 can slide relative to the friction member 140, thereby ensuring horizontal stiffness and transmitting horizontal force so as to ensure the normal running function of trains; when the seismic intensity is relatively large, the constraint between the friction member 140 and the second bearing plate 120 and the support panel 130 is released, and the friction caused by sliding displacement between the second bearing plate 120 and the support panel 130, dissipates energy. The gravity of the bridge body causes the the sliding displacement to generate frictional resistance to dissipate the seismic impact force and convert the seismic force into heat energy and dissipate same. Meanwhile, when the support panel 130 slides relative to the friction member 140, the first shock absorption member 150 can increase its energy dissipation through the hysteretic process of deformation and recovery, and when the second bearing plate 120 slides relative to the friction member 140, the second shock absorption member 160 can increase its energy dissipation through the hysteretic process of deformation and recovery, to achieve further shock absorption. The first shock absorption member 150 and the second shock absorption member 160 can drive the movement between the relatively sliding support panel 130 and the friction member 140 and the movement between the second bearing plate 120 and the friction member 140 toward the center balance position of the self-resetting friction-damping shock absorption bearing 100 to achieve automatic resetting.

It can be understood that the first shock absorption member 150 and the second shock absorption member 160 have good hysteretic characteristics and absorb a large amount of energy during the plastic hysteretic deformation process, and thus can further absorb the seismic energy during the earthquake process and improve the damping of the system, achieving a better shock absorption effect. In addition, the first shock absorption member 150 can also control the relative displacement between the support panel 130 and the friction member 140 within a certain range, and the second shock absorption member 160 can also control the relative displacement between the second bearing plate 120 and the friction member 140 within a certain range, so as to prevent a bridge falling accident caused by an excessive displacement.

It can be understood that the friction member 140 can define the direction in which the support panel 130 and the second bearing plate 120 slide relative to the friction member 140 when the support panel 130 and the second bearing plate 120 can slide relative to the friction member 140. Further, the first shock absorption member 150 and the second shock absorption member 160 are provided for further shock absorption and to reset the support panel 130 and the second bearing plate 120 after sliding.

It should be noted that there are two states of the connection between the friction member 140 and the support panel 130 and the second bearing plate 120. First, when there is no external force or the external force is small, the friction member 140 is fixedly connected to the support panel 130 and the second bearing plate 120. Second, when a large external force is applied, the friction member 140 is slidingly connected to the support panel 130 and the second bearing plate 120.

Preferably, the friction member 140 is respectively connected to the support panel 130 and the second bearing plate 120 through multiple sets of pins 170. The pin 170 can control the horizontal critical unlock load of the bearing. When the seismic intensity is less than this load, it plays a role in ensuring horizontal stiffness and transmitting horizontal force so as to ensure the normal running function of trains; when the seismic intensity is greater than this load, the pin 170 is sheared to achieve energy dissipation and shock absorption in a relative sliding manner.

Figure 3:
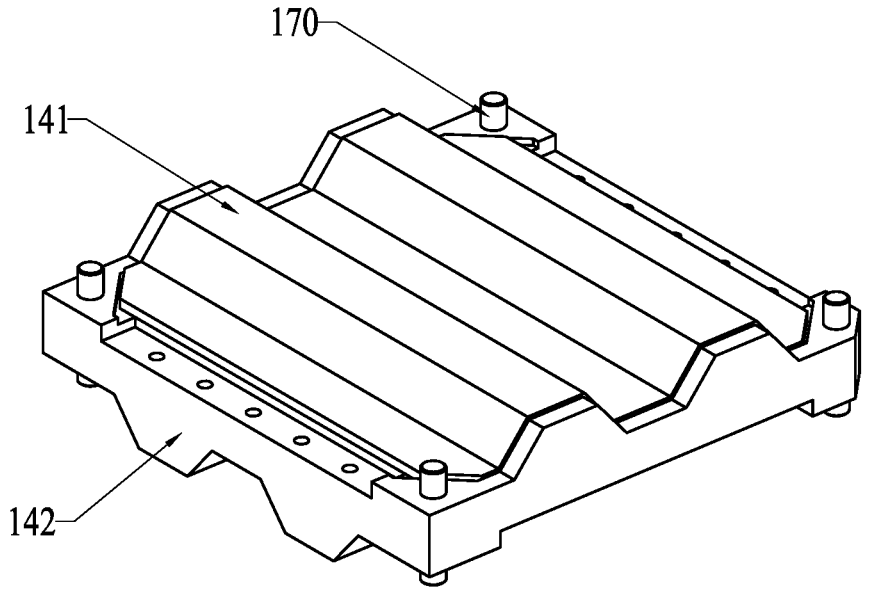
FIG. 3 is a schematic structural diagram of a friction member provided by the first embodiment of the present invention.
Figure 4:
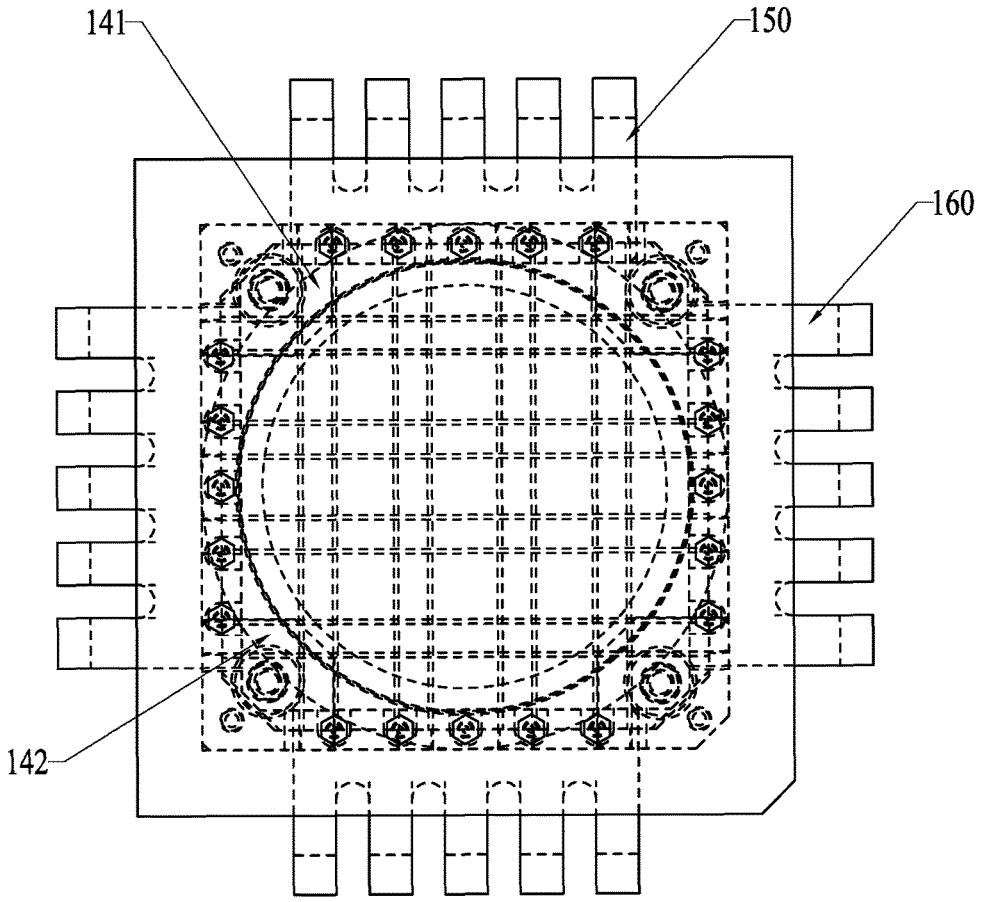
FIG. 4 is a schematic structural diagram in a horizontal projection direction of a first shock absorption member, a second shock absorption member, a first slide rail, and a second slide rail provided by the first embodiment of the present invention.

Referring to FIGS. 3 and 4, in the present embodiment, the friction member 140 is provided with a first slide rail 141 and a second slide rail 142, the first slide rail 141 and the second slide rail 142 are respectively provided on the two opposite sides of the friction member 140*s*, the support panel 130 is connected to the first slide rail 141 and can slide relative to the first slide rail 141, and the second bearing plate 120 is connected to the second slide rail 142 and can slide relative to the second slide rail 142.

It can be understood that the function of the first slide rail 141 and the second slide rail 142 is to decompose the force externally applied to the self-resetting friction-damping shock absorption bearing 100 provided by the present embodiment into the force along the extending direction of the first slide rail 141 and the force along the extending direction of the second slide rail 142, that is, the function of the first slide rail 141 and the second slide rail 142 is to decompose the force applied to the self-resetting friction-damping shock absorption bearing 100 in two directions, such that the force received in each direction and the resulting displacement become smaller, thereby achieving shock absorption effect.

Moreover, the reciprocating friction between the first slide rail 141 and the second slide rail 142 generates resistance, which converts the seismic shock into heat energy to dissipate, continuously dissipating seismic energy, and achieving a shock absorption function; at the same time, the first slide rail 141 and the second slide rail 142 can decompose the displacement in an earthquake situation along two directions, the first slide rail 141 and the second slide rail 142, to adapt to horizontal seismic displacements in different directions and reduce damages to the structure. The horizontal energy dissipation and displacement do not cause the change in the height of the self-resetting friction-damping shock absorption bearing 100 provided by this embodiment and the lifting of the bridge body mounted on the self-resetting friction-damping shock absorption bearing 100 and do not affect the mechanical structure of the bridge body.

It should be noted that the displacement of the support panel 130 and the second bearing plate 120 respectively relative to the first slide rail 141 and the second slide rail 142 can prolong the basic natural vibration period of the bridge structure, avoid the frequency range of seismic energy concentration, and reduce earthquake responses so as to achieve a good seismic isolation effect; the displacement decomposition increases horizontal displacement capability and improves the ability of the self-resetting friction-damping shock absorption bearing 100 to withstand a horizontal impact force.

It can be understood that the number of the first slide rail 141 and the second slide rail 142 may be one or two or more, and in this embodiment, the number of the first slide rail 141 and the second slide rail 142 is not specifically limited. the first slide rail 141 and the second slide rail 142 are opposite to each other. Through the adjustment of the number of the first slide rail 141 and the second slide rail 142, the magnitude of the frictional force of the friction member 140 can also be further adjusted.

In this embodiment, the extending direction of the first slide rail 141 and the extending direction of the second slide rail 142 are perpendicular to each other. Of course, the present invention is not limited to this. In other embodiments of the present invention, the extending direction of the first slide rail 141 and the extending direction of the second slide rail 142 may not be perpendicular to each other, for example, the extending direction of the first slide rail 141 and the extending direction of the second slide rail 142 are set at an acute angle.

In this embodiment, the first shock absorption member 150 is provided in the extending direction of the first slide rail 141, and the second shock absorption member 160 is provided in the extending direction of the second slide rail 142.

It can be understood that the first shock absorption member 150 is provided in the extending direction of the first slide rail 141, and when the support panel 130 slides along the first slide rail 141, can play a role of shock absorption and cushioning and can drive both to reset. Preferably, the number of the first shock absorption member 150 is two, and the two first shock absorption members 150 are respectively provided at opposite ends of the first slide rail 141 along the extending direction thereof.

Similarly, it can be understood that the second shock absorption member 160 is provided in the extending direction of the second slide rail 142, and when the second bearing plate 120 slides along the second slide rail 142, can play the role of shock absorption and cushioning and can bring both to reset. Preferably, the number of the second shock absorption member 160 is two, and the two second shock absorption members 160 are respectively provided at both ends of the second slide rail 142 in the extending direction thereof.

Figure 5:
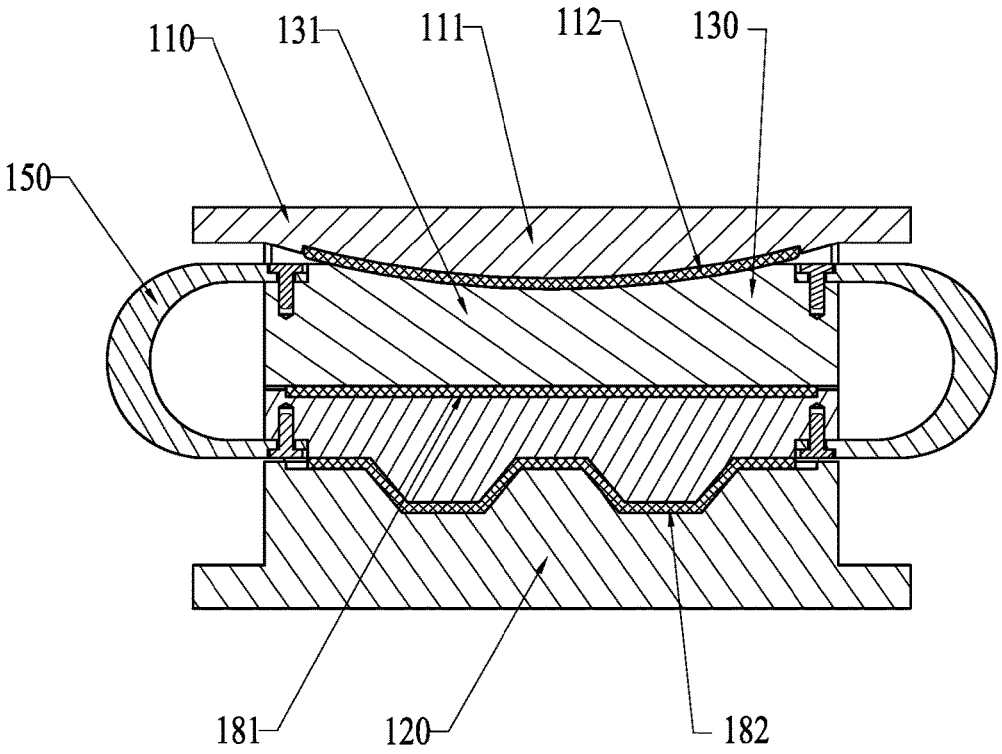
FIG. 5 is a schematic structural diagram of a first wear-resistant layer, a second wear-resistant layer, and a third wear-resistant layer provided by the first embodiment of the present invention.

Referring to FIGS. 3 and 5, in this embodiment, in order to increase the wear resistance between the relatively sliding support panel 130 and the friction member 140, and simultaneously adjust the frictional force, a first wear-resistant layer 181 is bonded between the first slide rail 141 and the support panel 130; in order to increase the wear resistance between the relatively sliding second bearing plate 120 and the friction member 140 and the adjustment of the frictional force, a second wear-resistant layer 182 is bonded between the second sliding rail 142 and the second bearing plate 120.

Figure 6:
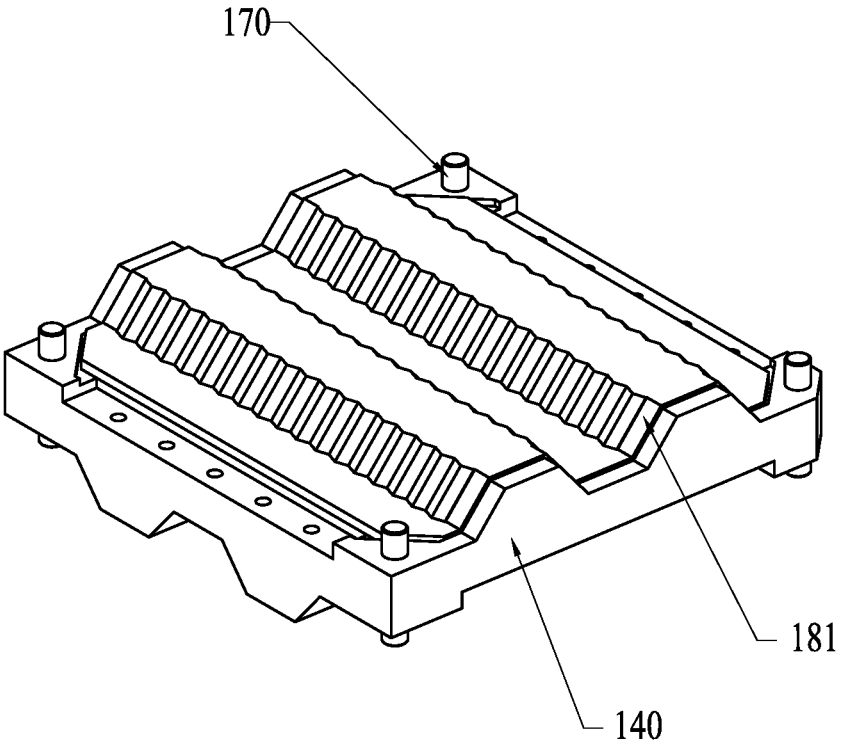
FIG. 6 is a schematic structural diagram of a first wear-resistant layer provided by another embodiment of the present invention.

Referring to FIG. 6, in other embodiments of the present utility model, the first wear-resistant layer 181 provided between the friction member 140 and the support panel 130 may also be provided in a folding face manner so as to further increase the frictional coefficients between the first wear-resistant layer 181 and the friction member 140 and the support panel 130. It can be understood that the wear-resistant plate is designed in an oblique plane direction to be a folding surface shape, and the wedge pressurization principle is used to increase the contact area so as to increase the lateral frictional force and increase the frictional energy dissipation capacity; when a slippage occurs, the folding surface structure squeezes, and a greater frictional force can be achieved under the same displacement conditions.

It can be understood that the second wear-resistant layer 182 can also adopt the structure of FIG. 6 described above to increase the frictional force between the second bearing plate 120 and the friction member 140.

It should be noted that the functions and effects of the first shock absorption member 150 and the second shock absorption member 160 are similar. In the following, only the specific structure and connection relationship of the first shock absorption member 150 are described in detail. The specific structure and connection relationship of the second shock absorption member 160 may refer to those of the first shock absorption member 150 and will not be described here.

Figure 7:
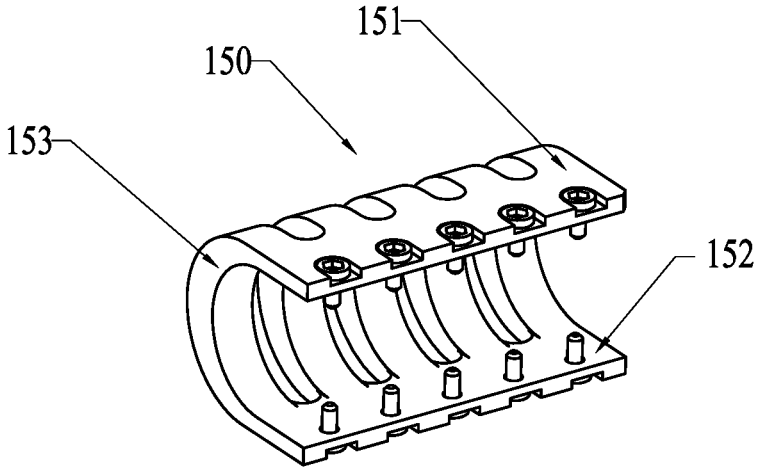
FIG. 7 is a schematic structural diagram of the first shock absorption member provided by the first embodiment of the present invention.

Referring to FIG. 7, in the present embodiment, the first shock absorption member 150 includes a first connecting portion 151, a second connecting portion 152, and a shock absorption connecting portion 153, both ends of the shock absorption connecting portion 153 being respectively connected to the first connecting portion and the second connecting portion 152, the first connecting portion 151 being connected to the support panel 130, the second connecting portion 152 being connected to the side of the friction member 140 away from the support panel 130.

In the present embodiment, the cross-sectional dimension of the shock absorption connecting portion 153 is larger than the cross-sectional dimension of the first connecting portion 151 or the cross-sectional dimension of the second connecting portion 152. That is, among the first connecting portion 151, the second connecting portion 152, and the shock absorption connecting portion 153, the cross-sectional dimension of the shock absorption connecting portion 153 is the largest.

It can be understood that the shear stress endured by the shock absorption connecting portion 153 is more complex than the stress endured by the first connecting portion 151 and the second connecting portion 152, and larger than the torsional stress endured by the first connecting portion 151 and the second connecting portion 152. The cross-sectional dimension of the shock absorption connecting portion 153 is greater than the width of the first connecting portion 151 and the second connecting portion 152 so that the shock absorption connecting portion 153 can bear more load than the first connecting portion 151 and the second connecting portion 152, thereby on the basis of ensuring a simple structure, ensuring the service life of the shock absorption connecting portion 153. At the same time, it also enhances the ability to absorb energy during the hysteretic process of deformation and reset, as well as drive the reset to provide enough power.

In the present embodiment, the first connecting portion 151 and the support panel 130 are connected by screws. Of course, the present invention is not limited to this. In other embodiments of the present invention, the first connecting portion 151 and the support panel 130 may also be connected together by other connection methods such as snapping, welding, or bonding.

Please refer to FIG. 5, in this embodiment, the side of the first bearing plate 110 near the support panel 130 is provided with a second shock absorption portion 111, and the side of the support panel 130 near the first bearing plate 110 is provided with the first shock absorption portion 131 which fits the second shock absorption portion 111.

In this embodiment, the second shock absorption portion 111 is a spherical protrusion, and the first shock absorption portion 131 is a spherical groove fitting the spherical protrusion.

Meanwhile, in the present embodiment, a third wear-resistant layer 112 is further provided between the first bearing plate 110 and the support panel 130 so as to reduce the wear between the first bearing plate 110 and the support panel 130.

Please still refer to FIG. 2, shock absorption rubber 191 is also provided between the first bearing plate 110 and the support panel 130, and the shock absorption rubber is provided on the first bearing plate 110 near the four corners thereof, and in this embodiment, the shock absorption rubber 191 is fixedly connected to the first bearing plate 110 via a bolt 192. As can be appreciated, the third wear-resistant layer 112 can increase the wear resistance and energy dissipation between the first bearing plate 110 and the support panel 130. The shock absorption rubber 191 receives and absorbs impact energy generated when the second shock absorption portion 111 is tilted or rotated.

The self-resetting friction-damping shock absorption bearing 100 provided in this embodiment has the following advantageous effects: when the seismic intensity is small, the support panel 130 and the second bearing plate 120 and the friction member 140 remain fixed, i.e. the support panel 130 and the second bearing plate 120 both can not slide relative to the friction member 140, thereby ensuring horizontal stiffness and transferring horizontal force, and ensuring the normal running function of trains; when the seismic intensity is relatively large, the constraint between the friction member 140 and the second bearing plate 120 and the support panels 130 is released, and the second bearing plate 120 and the support panel 130 slide and rub to dissipate energy. At the same time, the movement of the friction member 140 causes the first shock absorption member 150 and the second shock absorption member 160 to deform, absorbing a large amount of energy during the hysteretic process of deformation and recovery. After the earthquake disappears, the first shock absorption member 150 and the second shock absorption member 160 can drive the movement between the relatively sliding support panel 130 and the friction member 140 and the movement between the second bearing plate 120 and the friction member 140 toward the center balance position of the self-resetting friction-damping shock absorption bearing 100 to achieve automatic resetting. The first shock absorption member 150 and the second shock absorption member 160 control the relative displacement between the friction member 140, the support panel 130, and the second bearing plate 120 within a certain range, so as to prevent a bridge falling accident caused by an excessive displacement. The self-resetting friction-damping shock absorption bearing 100 provided in this embodiment has a simple structure and can effectively improve the horizontal energy dissipation and resetting ability without affecting the overall mechanical structure of the bridge.

Second Embodiment

This embodiment provides a shock absorption bridge (not shown) including a bridge body (not shown), a pier column (not shown) and a self-resetting friction-damping shock absorption bearing 100 provided by the first embodiment. The self-resetting friction-damping shock absorption bearing 100 includes a first bearing plate 110, a second bearing plate 120, a support panel 130, a friction member 140, a first shock absorption member 150, and a second shock absorption member 160. The first bearing plate 110 is connected to the support panel 130. Both ends of the friction member 140 are respectively connected to the second bearing plate 120 and one end of the support panel 130 away from the first bearing plate 110, and the friction member 140 can slide relative to the support panel 130 and the second bearing plate 120. One end of the first shock absorption member 150 is connected to the friction member 140, and the other end of the first shock absorption member 150 is connected to the support panel 130. One end of the second shock absorption member 160 is connected to the friction member 140, and the other end of the second shock absorption member 160 is connected to the second bearing plate 120. The self-resetting friction-damping shock absorption bearing 100 is located between the bridge body and the pier column, and the first bearing plate 110 is connected to the bridge body, and the second bearing plate 120 is connected to the pier column.

The foregoing descriptions are merely concerning preferred embodiments of the present invention and are not intended to limit the present invention. For those skilled in the art, the present invention may have various changes and alterations. Any modification, equivalent replacement, and improvement made within the spirit and principle of the present invention shall fall within the protection scope of the present invention.

What is claimed is:

1. A self-resetting friction-damping shock absorption bearing, comprising a first bearing plate, a second bearing plate, a support panel, a friction member, a first shock absorption member, and a second shock absorption member;

wherein, the first bearing plate is connected to the support panel, a first end and a second end of the friction member are respectively connected to the second bearing plate and a first end of the support panel away from the first bearing plate, and the friction member is slidable relative to the support panel and the second bearing plate;

a first end of the first shock absorption member is connected to the friction member, and a second end of the first shock absorption member is connected to the support panel;

a first end of the second shock absorption member is connected to the friction member, and a second end of the first shock absorption member is connected to the second bearing plate;

the friction member is respectively connected to the support panel and the second bearing plate through multiple sets of pins, and when the seismic intensity is less than the shear load of the pin, the friction member is fixedly connected to the support panel and the second bearing plate; when the seismic intensity is greater than the shear load of the pin, the friction member is sliding connected to the support panel and the second bearing plate;

the friction member is provided with a first slide rail and a second slide rail; the first slide rail and the second slide rail are respectively provided on two opposite sliding surfaces of the friction member; the support panel is connected to the first slide rail and is slidable relative to the first slide rail; and the second bearing plate is connected to the second slide rail and is slidable relative to the second slide rail;

the first shock absorption member is provided in a direction that the first slide rail extends; the second shock absorption member is provided in a direction that the second slide rail extends.

2. The self-resetting friction-damping shock absorption bearing according to claim 1, wherein the direction that the first slide rail extends is perpendicular to the direction that the second slide rail extends.

3. The self-resetting friction-damping shock absorption bearing according to claim 1, characterized in that, a first wear-resistant layer is bonded between the first slide rail and the support panel; a second wear-resistant layer is also bonded between the second slide rail and the second bearing plate; and the first wear-resistant layer and the second wear-resistant layer are planar or folded.

4. The self-resetting friction-damping shock absorption bearing according to claim 1, characterized in that, the first shock absorption member comprises a first connecting portion, a second connecting portion, and a shock absorption connecting portion; a first end and a second end of the shock absorption connecting portion are respectively connected to the first connecting portion and the second connecting portion; the first connecting portion is connected to the support panel; the second connecting portion is connected to the side of the friction member away from the support panel.

5. The self-resetting friction-damping shock absorption bearing according to claim 4, characterized in that, a cross-sectional dimension of the shock absorption connecting portion is greater than a cross-sectional dimension of the first connecting portion, or larger than a cross-sectional dimension of the second connecting portion.

6. The self-resetting friction-damping shock absorption bearing according to claim 4, characterized in that, the first connecting portion is snapped, welded or screwed to the support panel.

7. The self-resetting friction-damping shock absorption bearing according to claim 1, wherein a side of the support panel near the first bearing plate is provided with a first shock absorption portion; and a side of the first bearing plate adjacent to the support panel is provided with a second shock absorption portion that fits the first shock absorption portion.

8. A shock absorption bridge, comprising a bridge body, a pier column, and a self-resetting friction-damping shock absorption bearing of claim 1, wherein the self-resetting friction-damping shock absorption bearing is located between a bridge body and a pier column; and the first bearing plate is connected to the bridge body; and the second bearing plate is connected to the pier column.

* * * * *